US009329531B2

(12) United States Patent
Yotsutsuji

(10) Patent No.: US 9,329,531 B2
(45) Date of Patent: May 3, 2016

(54) DEVELOPING DEVICE, IMAGE FORMING UNIT AND IMAGE FORMING APPARATUS PROVIDED WITH THE SAME

(75) Inventor: Takefumi Yotsutsuji, Osaka (JP)

(73) Assignee: KYOCERA MITA CORPORATION, Osaka-shi (JP)

( * ) Notice: Subject to any disclaimer, the term of this patent is extended or adjusted under 35 U.S.C. 154(b) by 372 days.

(21) Appl. No.: 13/185,648

(22) Filed: Jul. 19, 2011

(65) Prior Publication Data

US 2012/0020688 A1 Jan. 26, 2012

(30) Foreign Application Priority Data

Jul. 23, 2010 (JP) ..... 2010-165977

(51) Int. Cl.
*G03G 15/095* (2006.01)
*G03G 15/09* (2006.01)

(52) U.S. Cl.
CPC ..... *G03G 15/095* (2013.01); *G03G 15/0907* (2013.01)

(58) Field of Classification Search
CPC ..... G03G 15/095; G03G 15/0907
USPC ..... 399/55, 270, 285, 354
See application file for complete search history.

(56) References Cited

U.S. PATENT DOCUMENTS

| | | | | |
|---|---|---|---|---|
| 2007/0019995 | A1* | 1/2007 | Teraoka et al. | 399/281 |
| 2009/0003855 | A1* | 1/2009 | Kubo | 399/44 |
| 2009/0175636 | A1 | 7/2009 | Hayase et al. | |
| 2009/0245886 | A1* | 10/2009 | Sakata | 399/270 |
| 2009/0317142 | A1* | 12/2009 | Takai | 399/270 |
| 2009/0317143 | A1* | 12/2009 | Hamada | 399/270 |

FOREIGN PATENT DOCUMENTS

| | | |
|---|---|---|
| JP | 2002-148932 | 5/2002 |
| JP | 2008-268664 | 11/2008 |
| JP | 2009-162962 | 7/2009 |
| JP | 2009-265273 | 11/2009 |

* cited by examiner

*Primary Examiner* — Rodney Bonnette
(74) *Attorney, Agent, or Firm* — Gerald E. Hespos; Michael J. Porco; Matthew T. Hespos

(57) ABSTRACT

A developing device includes an applying portion for applying a bias at a first voltage value and a first frequency, to a toner bearing member during a development period in which toner particles are supplied to an image bearing member. A controller executes a removal control to remove attached matter adhering to a bearing surface of the toner bearing member during a non-development period. Upon executing the removal control, the controller first causes residual toner particles to separate from the bearing surface. Subsequently, the controller controls the applying portion to cause a second bias at a second voltage value higher than the first voltage value or at a second frequency higher than the first frequency to be applied to the toner bearing member while bringing a developer layer on a developer bearing member into contact with the bearing surface.

8 Claims, 8 Drawing Sheets

DEVELOPING DEVICE, IMAGE FORMING UNIT AND IMAGE FORMING APPARATUS PROVIDED WITH THE SAME

BACKGROUND OF THE INVENTION

1. Field of the Invention

The present invention relates to a developing device and an image forming unit used for electrophotographic image formation, and an image forming apparatus provided with the same.

2. Description of the Related Art

An electrophotographic image forming apparatus such as a copier, a printer or a facsimile machine includes a developing device for forming a toner image on an image bearing member by supplying a developer to an electrostatic latent image formed on the image bearing member (e.g. photoconductive drum or transfer belt) and developing the electrostatic latent image.

The developing device includes, as main constituent elements, a storage portion for storing a developer including nonmagnetic toner particles and magnetic carrier particles while agitating them, a magnetic roller forbearing a developer layer (so-called magnetic brush layer) by receiving the developer from the storage portion, and a developing roller for receiving and bearing the toner particles from the magnetic brush layer on a bearing surface based on a potential difference between the developing roller and the magnetic roller and then supplying the toner particles to the image bearing member based on a potential difference between the developing roller and the image bearing member.

In the developing device constructed as described above, an attached matter in the form of a thin film is likely to be formed on the bearing surface of the developing roller due to the long-term use of the developing device and a continuous printing operation at a high coverage rate. The attached matter is toner particles, external additive of the toner particles and the like. If an attached matter is formed on the bearing surface, the resistance of the bearing surface increases and electric charges are accumulated on the bearing surface. Thus, an apparent voltage increases. This reduces the potential difference between the developing roller and the magnetic roller and the developing roller cannot sufficiently receive the toner particles from the magnetic roller. As a result, there is a problem of reducing the density of a toner image formed on the image bearing member.

As a countermeasure against the above problem, the attached matter on the bearing surface of the developing roller needs to be removed to suppress a reduction in the density of the toner image. In a conventional developing device, the rotating speed of a magnetic roller is made slower or a distance between a developing roller and the magnetic roller is made shorter when a developing operation is not performed than when the developing operation is performed, thereby strongly bringing a magnetic brush layer on the magnetic roller into contact with an attached matter to remove the attached matter.

In the conventional developing device, no special member is employed to remove the attached matter, but it is difficult to remove the attached matter only by changing the rotating speed of the magnetic roller or the distance between the developing roller and the magnetic roller particularly when the thickness of the attached matter is large.

SUMMARY OF THE INVENTION

An object of the present invention is to provide a developing device and an image forming unit capable of easily removing an attached matter formed on a toner bearing member even when the thickness of the attached matter is large, and an image forming apparatus provided with the same.

In order to accomplish this object, one aspect of the present invention is directed to a developing device for performing a developing operation of supplying toner particles to a predetermined image bearing member, comprising a storage portion for storing a developer containing toner particles and carrier particles; a developer bearing member for receiving the developer from the storage portion and bearing a developer layer while rotating in a predetermined direction; a toner bearing member having a bearing surface for receiving the toner particles from the developer and bearing a toner layer while rotating in contact with the developer layer and adapted to supply the toner particles in the toner layer to the image bearing member during a development period in which the developing operation is performed; a drive source for rotating the developer bearing member and the toner bearing member; an applying portion for applying a first bias, the voltage value of which is a first voltage value and the frequency of which is a first frequency, to the toner bearing member during the development period; a separating portion for separating residual toner particles remaining on the bearing surface from the bearing surface during a non-development period in which the developing operation is not performed; and a controller for executing a removal control to remove an attached matter adhering to the bearing surface of the toner bearing member during the non-development period; wherein, upon executing the removal control, the controller first controls the separating portion to separate the residual toner particles from the bearing surface and then controls the applying portion to cause a second bias, at least the voltage value of which is set at a second voltage value higher than the first voltage value of the first bias or the frequency of which is set at a second frequency higher than the first frequency of the first bias, to be applied to the toner bearing member while controlling the drive source to rotate the developer bearing member and the toner bearing member, thereby bringing the developer layer into contact with the bearing surface.

Another aspect of the present invention is directed to an image forming apparatus, comprising an image bearing member on which a toner image is to be formed; the above developing device for performing a developing operation of supplying toner particles to the image bearing member; a transfer member for transferring the toner image onto a sheet; and a fixing unit for fixing the toner image on the sheet to the sheet.

Sill another aspect of the present invention is directed to an image forming unit, comprising an image bearing member for bearing a toner image; a developer bearing member for bearing a developer layer containing toner particles and carrier particles; a toner bearing member facing the image bearing member and the developer bearing member and adapted to receive toner particles from the developer layer and bear a toner layer and supply the toner particles in the toner layer to the image bearing member; an applying portion for applying a bias to the toner bearing member; a drive source for rotating the developer bearing member and the toner bearing member; and a controller for controlling the operations of the applying portion and the drive source; wherein the controller controls the applying portion to apply a first bias, the voltage value of which is a first voltage value and the frequency of which is a first frequency, to the toner bearing member during a development period in which a developing operation of supplying toner particles to the image bearing member is performed; and successively performs a first step of causing the applying portion to apply a bias for producing a potential difference, which causes residual toner particles on the circumferential surface of the toner bearing member to migrate to the image bearing member, between the toner bearing member and the image bearing member while rotating the toner bearing member by means of the drive source and a second step of controlling the applying portion to apply a second bias, at least the voltage value of which is set at a second voltage value higher than the first voltage value of the first bias or the frequency of which is set at a second frequency higher than the first frequency of the first bias, to be applied to the toner bearing member while rotating the developer bearing member and the toner bearing member by means of the drive source during a non-development period in which the developing operation is not performed.

These and other objects, features and advantages of the present invention will become more apparent upon reading the following detailed description along with the accompanying drawings.

DETAILED DESCRIPTION OF THE PREFERRED EMBODIMENTS

Figure 1:
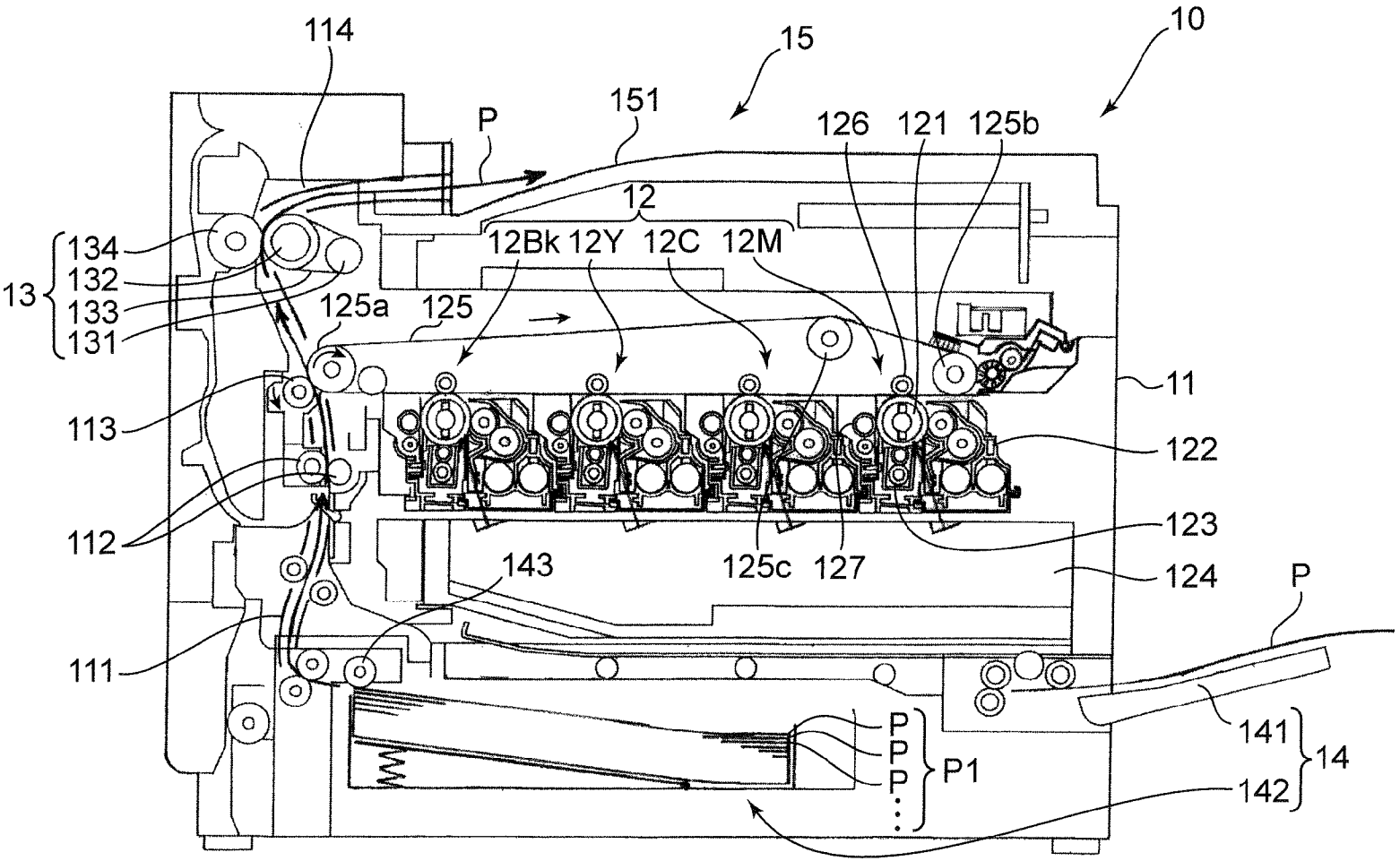
FIG. 1 is a sectional view schematically showing the internal structure of an image forming apparatus according to an embodiment of the invention.

Hereinafter, an embodiment according to the present invention is described with reference to the drawings. FIG. 1 is a sectional view schematically showing the internal structure of an image forming apparatus according to this embodiment. The image forming apparatus 10 is, for example, a tandem color printer and includes a box-shaped apparatus main body 11. The apparatus main body 11 is internally provided with an image forming station 12 for forming an image based on image information transmitted from an external apparatus such as a computer, a fixing unit 13 for performing a fixing process on an image formed by the image forming station 12 and transferred to a sheet P, and a sheet storage unit 14 for storing sheets P used for image transfer. A sheet discharge unit 15, to which the sheet P after the fixing process is discharged, is provided on the top of the apparatus main body 11.

The image forming station 12 is for forming a toner image on a sheet P fed from the sheet storage unit 14 and includes a magenta unit 12 M (one type of an image forming unit) using magenta toner (developer), a cyan unit 12C using cyan toner, a yellow unit 12Y using yellow toner and a black unit 12Bk using black toner which are successively arranged from an upstream side (right side on the plane of FIG. 1) toward a downstream side.

Each of the units 12M, 12C, 12Y and 12Bk includes a photoconductive drum 121 (image bearing member) and a developing device 122 for performing a developing operation of supplying toner particles to the circumferential surface of the photoconductive drum 121. Each photoconductive drum 121 has an electrostatic latent image and a toner image (visible image) in conformity with this electrostatic latent image formed on the circumferential surface thereof and receives the supply of toner particles from the corresponding developing device 122 while rotating in a counterclockwise direction in FIG. 1. Each developing device 122 receives the supply of the toner particles from an unillustrated toner cartridge mounted in the apparatus main body 11.

Chargers 123 are disposed right below the respective photoconductive drums 121 and an exposure device 124 is provided below the respective chargers 123. The circumferential surfaces of the respective photoconductive drums 121 are uniformly charged by the chargers 123, and laser beams based on image data input from a computer or the like and corresponding to the respective colors are irradiated to the charged circumferential surfaces of the photoconductive drums 121 from the exposure device 124. In this way, electrostatic latent images are formed on the circumferential surfaces of the respective photoconductive drums 121. When the developing devices 122 supply the toner particles to the electrostatic latent images, toner images are developed on the circumferential surfaces of the photoconductive drums 121.

A transfer belt 125 mounted between a drive roller 125*a* and a driven roller 125*b* is arranged above the photoconductive drums 121. The transfer belt 125 rotates between the drive roller 125*a* and the driven roller 125*b* in synchronization with the respective photoconductive drums 121 while being pressed against the circumferential surfaces of the photoconductive drums 121 by transfer rollers 126 disposed in correspondence with the respective photoconductive drums 121.

A tension roller 125*c* is disposed at a position close to the driven roller 125*b* between the drive roller 125*a* and the driven roller 125*b*. The tension roller 125*c* applies a tension to the transfer belt 125 and is biased upward by a biasing force of an unillustrated biasing member.

As the transfer belt 125 rotates, a magenta toner image is first primarily transferred to a surface of the transfer belt 125 by the photoconductive drum 121 of the magenta unit 12M. Subsequently, a cyan toner image is transferred in a superimposition manner to the transferred position of the magenta toner image on the transfer belt 125 by the photoconductive drum 121 of the cyan unit 12C. Thereafter, similarly, a yellow toner image and a black toner image are transferred in a superimposition manner by the yellow unit 12Y and the black unit 12Bk. In this way, a full color toner image is formed on the surface of the transfer belt 125.

A drum cleaner 127 for cleaning the circumferential surface of the photoconductive drum 121 by removing the residual toner particles is arranged to the left of each photoconductive drum 121 in FIG. 1. The circumferential surface of the photoconductive drum 121 cleaned by the drum cleaner 127 heads for the charger 123 for a new charging process. The waste toner particles removed from the circumferential surface of the photoconductive drum 121 by the drum cleaner 127 are collected into an unillustrated toner collection bottle via a predetermined path.

A vertically extending sheet conveyance path 111 is formed to the left of the image forming station 12 in FIG. 1. Pairs of conveyor rollers 112 are provided at specified positions in the sheet conveyance path 111, and a sheet P from the sheet storage unit 14 is conveyed toward the transfer belt 125 by driving the pairs of conveyor rollers 112. Further, a secondary transfer roller 113 in contact with the surface of the transfer belt 125 at a position facing the drive roller 125*a* is provided in the sheet conveyance path 111. A transfer nip portion is formed between the secondary transfer roller 113 and the surface of the transfer belt 125. The sheet P is pressed and held between the transfer belt 125 and the secondary transfer roller 113 in the transfer nip portion, whereby the toner image on the transfer belt 125 is secondarily transferred to the sheet P.

The sheet storage unit 14 includes a manual feed tray 141 openably and closably provided on the right wall of the apparatus main body 11 in FIG. 1 and a sheet tray 141 detachably mounted below the exposure device 124 in the apparatus main body 11. A sheet stack P1, in which a plurality of sheets P are stacked, is stored in the sheet tray 142. The sheet tray 142 is a box with an open upper side and the sheet stack P1 can be stored therein. The uppermost sheet P of the sheet stack P1 stored in the sheet tray 142 is fed one by one toward the sheet conveyance path 111 by driving a pickup roller 143. The sheet P fed from the sheet tray 142 is conveyed toward the transfer nip portion via the sheet conveyance path 111 by driving the pairs of the conveyor rollers 112.

The fixing unit 13 performs a fixing process on a secondarily transferred toner image on a sheet P. The fixing unit 13 includes a heating roller 131 internally provided with an electric heating element as a heat source, a fixing roller 132 arranged to face the heating roller 131, a fixing belt 133 mounted between the fixing roller 132 and the heating roller 131, and a pressure roller 134 arranged to face the fixing roller 132 via the fixing belt 133. A sheet P fed to the fixing unit 13 is subjected to the fixing process by receiving heat from the fixing belt 133 while passing between the pressure roller 134 and the fixing belt 133 having a high temperature. The color printed sheet P finished with the fixing process is discharged toward a discharge tray 151 of the sheet discharge unit 15 via a discharge conveyance path 114 extending from an upper part of the fixing unit 13.

Figure 2:
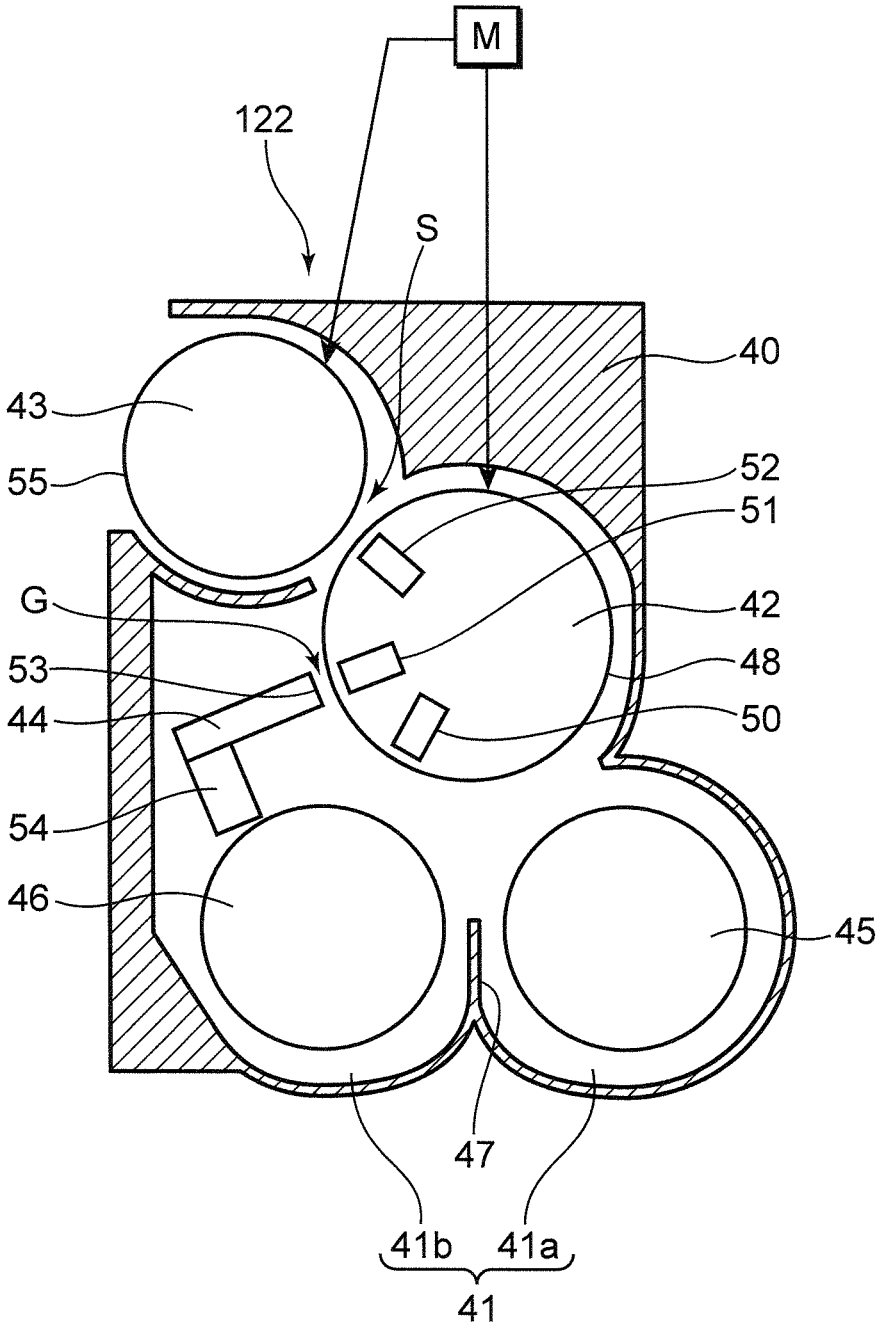
FIG. 2 is a sectional view schematically showing the internal structure of a developing device.

FIG. 2 is a sectional view schematically showing the internal structure of the developing device 122. The developing device 122 includes a developer container 40 which defines the internal space of the developing device 122. The developing device 122 includes, in the developer container 40, a developer storage portion 41 (storage portion) which stores a developer containing nonmagnetic toner particles and magnetic carrier particles and can convey the developer while agitating it, a magnetic roller 42 (developer bearing member) arranged above the developer storage portion 41, a developing roller 43 (toner bearing member) arranged to face the magnetic roller 42 at a position diagonally above the magnetic roller 42, and a developer restricting blade 44 (restricting member) arranged to face the magnetic roller 42.

The developer storage portion 41 is composed of two developer storage chambers 41*a*, 41*b* adjacent to each other and extending in a longitudinal direction of the developing device 122. The developer storage chambers 41*a*, 41*b* are partitioned from each other in the longitudinal direction by a partition plate 47 formed integrally to the developer container 40, but communicate with each other at the opposite ends in the longitudinal direction. Screw feeders 45, 46 for agitating the developer by rotation are rotatably mounted in the respective developer storage chambers 41*a*, 41*b*. Since the rotating directions of the screw feeders 45, 46 are set to be opposite to each other, the developer is conveyed in a circulating manner while being agitated between the developer storage chambers 41*a*, 41*b*. By this agitation, the toner particles and the carrier particles are mixed and the toner particles are, for example, negatively charged.

The magnetic roller 42 is arranged to extend in the longitudinal direction of the developing device 122 and rotatable in a clockwise direction in FIG. 2. A fixed so-called magnet roll (not shown) is arranged in the magnetic roller 42. The magnet roll includes a plurality of magnetic poles and, in this embodiment, includes a pumping pole 50, a restricting pole 51 and a main pole 52. The pumping pole 50 faces the developer storage portion 41, the restricting pole 51 faces the developer restricting blade 44 and the main pole 52 faces the developing roller 43.

The magnetic roller 42 magnetically pumps up (receives) the developer from the developer storage portion 41 to a circumferential surface 48 by a magnetic force of the pumping pole 50. The pumped-up developer is magnetically held as a developer layer (magnetic brush layer) on the circumferential surface 48 of the magnetic roller 42 and conveyed toward the developer restricting blade 44 according to the rotation of the magnetic roller 42.

The developer restricting blade 44 is located upstream of the developing roller 43 in the rotating direction of the magnetic roller 42 and restricts the thickness of the developer layer magnetically adhering to the circumferential surface 48 of the magnetic roller 42. The developer restricting blade 44 is a plate member made of a magnetic material and extending in a longitudinal direction of the magnetic roller 42 and supported by a specified supporting member 54 fixed at an appropriate position of the developer container 40. The developer restricting blade 44 has a restricting surface 53 (i.e. leading end surface of the developer restricting blade 44) and a restricting gap G of a predetermined dimension is formed between the restricting surface 53 and the circumferential surface 48 of the magnetic roller 42.

The developer restricting blade 44 made of the magnetic material is magnetized by the restricting pole 51 of the magnetic roller 42, whereby a magnetic path is formed between the restricting surface 53 of the developer restricting blade 44 and the restricting pole 51, i.e. in the restricting gap G. When the developer layer adhering to the circumferential surface 48 of the magnetic roller 42 by the pumping pole 50 is conveyed into the restricting gap G according to the rotation of the magnetic roller 42, the thickness of the developer layer is restricted in the restricting gap G to form the developer layer with a uniform predetermined thickness on the circumferential surface 48.

The developing roller 43 is arranged to extend in the longitudinal direction of the developing device 122 and in parallel to the magnetic roller 42, and rotatable in a clockwise direction in FIG. 2. The developing roller 43 has a circumferential surface 55 (bearing surface) which bears a toner layer by receiving toner particles from the developer layer while rotating in contact with the developer layer held on the circumferential surface 48 of the magnetic roller 42. During a development period in which a developing operation is performed, the toner particles in the toner layer are supplied to the circumferential surface of the photoconductive drum 121.

The developing roller 43 and the magnetic roller 42 are driven and rotated by a drive source M. A clearance S of a predetermined dimension is formed between the circumferential surface 55 of the developing roller 43 and the circumferential surface 48 of the magnetic roller 42. The clearance S is, for example, set at about 130 μm. The developing roller 43 is arranged to face the photoconductive drum 121 through an opening formed in the developer container 40, and a clearance of a predetermined dimension is also formed between the circumferential surface 55 and the circumferential surface of the photoconductive drum 121.

Figure 3:
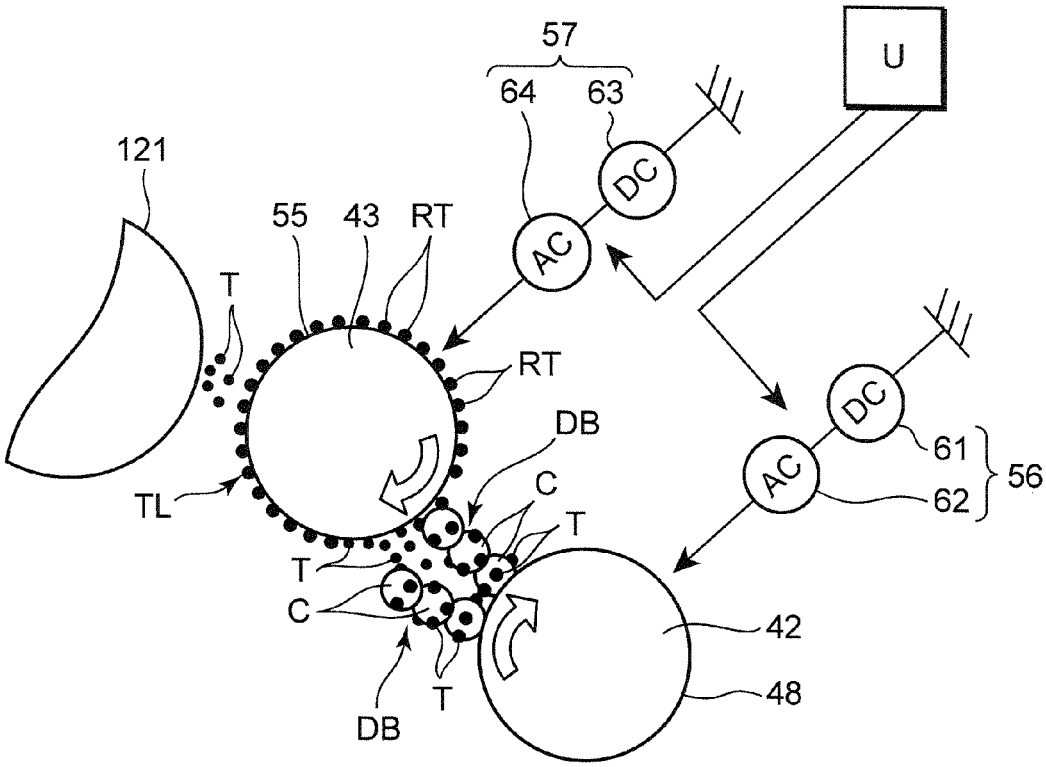
FIG. 3 is a diagram showing a developing operation of the developing device.

Next, the developing operation of the developing device 122 is described with reference to FIG. 3. To control the developing operation, the developing device 122 further includes a first applying portion 56, a second applying portion 57, and a controller U for controlling the first and second applying portions 56, 57. As shown in FIG. 3, the first applying portion 56 includes a direct-current voltage source 61 and an alternating-current voltage source 62 connected in series, and is connected to the magnetic roller 42. A voltage, in which an alternating-current bias output from the alternating-current voltage source 62 is superimposed on a direct-current bias output from the direct-current voltage source 61, is applied to the magnetic roller 42. The second applying portion 57 includes a direct-current voltage source 63 and an alternating-current voltage source 64 connected in series, and is connected to the developing roller 43. A voltage, in which an alternating-current bias output from the alternating-current voltage source 64 is superimposed on a direct-current bias output from the direct-current voltage source 63, is applied to the developing roller 43.

During the development period in which the developing device 122 supplies the toner particles onto the circumferential surface of the photoconductive drum 121 (develops an electrostatic latent image), the alternating-current biases and the direct-current biases applied to the magnetic roller 42 and the developing roller 43 are set as follows under the control by the controller U. The direct-current bias applied to the magnetic roller 42 is +300 to 500 V and the direct-current bias applied to the developing roller 43 is +100 V. It is appropriate to set a potential difference between the magnetic roller 42 and the developing roller 43 in a range of 200 to 400 V. Further, the alternating-current bias (Vpp) applied to the magnetic roller 42 has a voltage value of +300 to 500 V and a frequency of 2 to 4 kHz. The alternating-current bias (first bias) (Vpp) applied to the developing roller 43 has a voltage value of, e.g. +1.4 kV (first voltage value) and a frequency of, e.g. 4.2 kHz (first frequency).

The magnetic brush layer on the circumferential surface 48 of the magnetic roller 42 is conveyed toward the developing roller 43 according to the rotation of the magnetic roller 42 after having the thickness thereof uniformly restricted by the developer restricting blade 44. Thereafter, a multitude of magnetic bristles DB in the magnetic brush layer come into contact with the circumferential surface 55 of the rotating developing roller 43 in the area of the clearance S (FIG. 2).

At this time, the controller U controls the first and second applying portions 56, 57 to apply the direct-current biases and the alternating-current biases set as above to the respective magnetic roller 42 and developing roller 43, whereby a predetermined potential difference is produced between the circumferential surface 48 of the magnetic roller 42 and the circumferential surface 55 of the developing roller 43. By this potential difference, only toner particles T migrate to the circumferential surface 55 from the magnetic bristles DB at a facing position of the circumferential surfaces 48, 55 (at a facing position of the main pole 52 (FIG. 2) and the circumferential surface 55) and the carrier particles C of the magnetic bristles DB remain on the circumferential surface 48. In this way, a toner layer TL with a predetermined thickness is beared on the circumferential surface 55 of the developing roller 43.

The toner layer TL on the circumferential surface 55 is conveyed toward the circumferential surface of the photoconductive drum 121 according to the rotation of the developing roller 43. Since a superimposed voltage of a direct-current voltage and an alternating-current voltage is also applied to the photoconductive drum 121, a predetermined potential difference is produced between the circumferential surface of the photoconductive drum 121 and the circumferential surface 55 of the developing roller 43. By this potential difference, the toner particles Tin the toner layer TL migrate to the circumferential surface of the photoconductive drum 121. In this way, the electrostatic latent image on the circumferential surface of the photoconductive drum 121 is developed to form a toner image.

Out of the toner particles T in the toner layer TL, residual toner particles RT remaining on the circumferential surface 55 without migrating to the photoconductive drum 121 are collected by the magnetic bristles DB when being conveyed to the facing position of the circumferential surface 55 and the circumferential surface 48 of the magnetic roller 42 according to the rotation of the developing roller 43. The magnetic bristles DB carrying the collected toner particles RT are separated by a magnetic force of a separation pole (not shown) of the magnet roll and returned to the developer storage portion 41 (FIG. 2) when being conveyed to a side downstream of the main pole 52 according to the rotation of the magnetic roller 42.

The developing device 122 constructed as above forms a toner image using the toner particles T to which an external additive such as silica is attached. The external additive such as silica imparts a charging property to the toner particles T. When the toner particles T and the carrier particles C are mixed and agitated in the developer storage portion 41, the toner particles T are charged by this external additive. The external additive is easily peeled off from the toner particles T when the developing device 122 is used for a prolonged period or when the developing device 122 continuously performs the developing operation at a high coverage rate, and forms an attached matter in the form of a thin film on the circumferential surface 55 of the developing roller 43.

Figure 4:
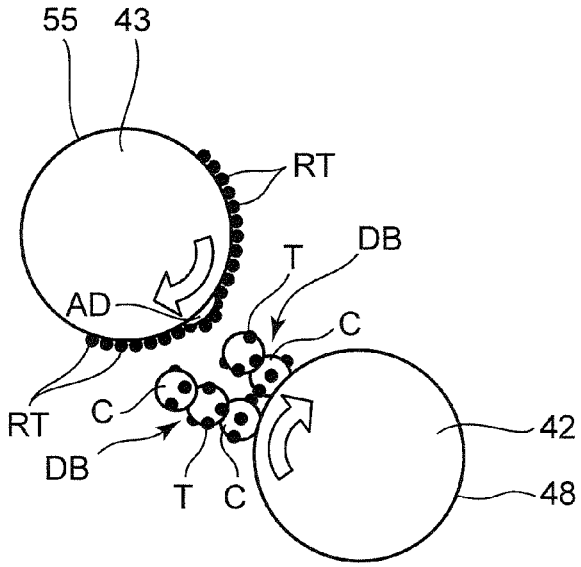
FIG. 4 is a diagram showing a state where an attached matter on a developing roller is covered by residual toner particles.

The residual toner particles RT on the circumferential surface 55 of the developing roller 43 are not completely collected by the magnetic bristles DB. The residual toner particles RT remaining on the circumferential surface 55 without being collected cover an attached matter AD as shown in FIG. 4. Thus, a contact force of the magnetic bristles DB with the attached matter AD weakens and the attached matter AD cannot be scraped off from the circumferential surface 55.

If the attached matter AD remains on the circumferential surface without being scraped off, electrical resistance of the circumferential surface 55 increases and electric charges are accumulated on the circumferential surface 55. Thus, the potential of the developing roller 43 varies on the surface. This causes a reduction in the potential difference between the developing roller 43 and the magnetic roller 42, whereby the developing roller 43 cannot sufficiently receive the toner particles T from the magnetic brush layer. As a result, there is a problem of reducing the density of the toner image formed on the photoconductive drum 121.

In this embodiment, the controller U executes a removal control to remove the attached matter AD to prevent a reduction in the density of the toner image resulting from the attached matter AD. The removal control is executed during a non-development period during which the developing device 122 does not perform the developing operation of supplying the toner particles onto the circumferential surface of the photoconductive drum 121. The non-development period is a period between a certain printing operation and the succeeding printing operation, i.e. a sheet-to-sheet interval, a period between the end of all the printing operations and the start of a printing operation, or a like period. The removal control is described below with reference to FIGS. 5 to 7.

Figure 5:
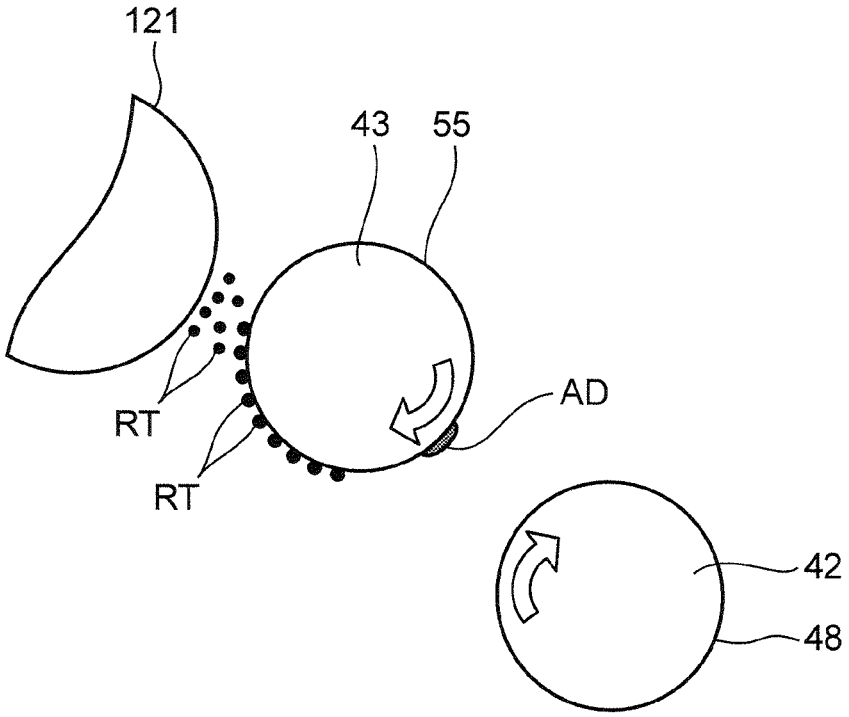
FIG. 5 is a diagram showing a separation step of a removal control by a controller.
Figure 6:
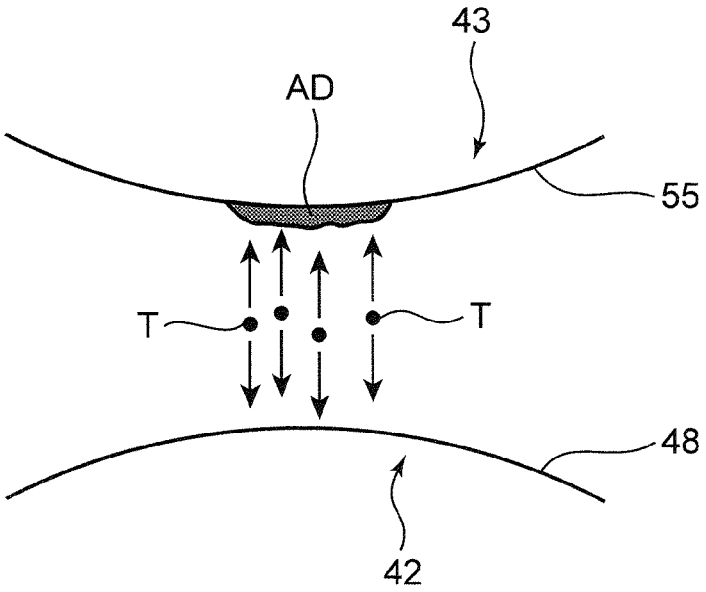
FIG. 6 is a diagram showing a collision step of the removal control.
Figure 7:
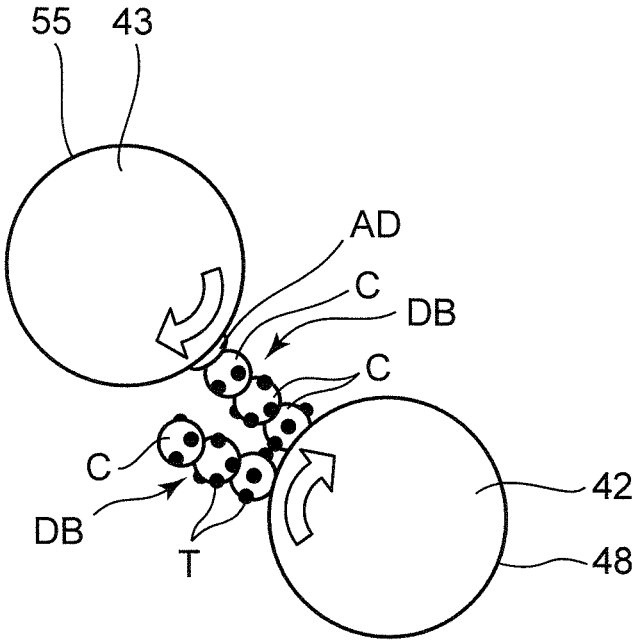
FIG. 7 is a diagram showing a scraping step of the removal control.

Roughly speaking, a separation step, a collision step and a scraping step are successively performed in the removal control. In the separation step, the residual toner particles RT on the circumferential surface 55 of the developing roller 43 are forcibly separated and discharged to the outside of the developing device 122 via the photoconductive drum 121. In the collision step, the toner particles T in the magnetic bristles DB are caused to collide with the attached matter AD. In the scraping step, the attached matter AD is scraped off by the magnetic bristles DB. FIG. 5 is a diagram showing the separation step, FIG. 6 is a diagram showing the collision step and FIG. 7 is a diagram showing the scraping step.

First, the separation step is performed as follows. The controller U controls the second applying portion 57 so that such a potential difference as to separate the residual toner particles RT on the circumferential surface 55 of the developing roller 43 and cause them to migrate to the photoconductive drum 121 is produced between the developing roller 43 and the photoconductive drum 121. By the separation step, the residual toner particles RT covering the attached matter AD migrate to the photoconductive drum 121, wherefore the attached matter AD is exposed. In the separation step, the developing roller 43 is rotated at least one turn. This enables the residual toner particles RT on the circumferential surface 55 to completely migrate to the photoconductive drum 121. The developing roller 43 is rotated by the control of the drive source M by the controller U. In this embodiment, the second applying portion 57 constitutes a separating portion for discharging the residual toner particles RT on the circumferential surface 55 to the outside of the developing device 122.

Subsequently, the controller U performs the collision step. The controller U first controls the drive source M to rotate the magnetic roller 42 and the developing roller 43, thereby bringing the magnetic bristles DB into contact with the circumferential surface 55 of the developing roller 43. Then, the controller U controls the second applying portion 57 to apply a second bias, at least one of the voltage value and the frequency of which is set higher than the first bias (alternating-current bias) at the time of the developing operation. In other words, the controller U controls the second applying portion 57 so that the voltage value is set at a second voltage value (e.g. 1.7 kV) higher than the first voltage value (1.4 kV) during the development period or the frequency is set at a second frequency (e.g. 8 kHz) higher than the first frequency (4.2 kHz) during the development period. Note that the controller U also controls the first applying portion 56 at this time to produce a potential difference between the magnetic roller 42 and the developing roller 43, thereby creating a situation where the toner particles T in the magnetic bristles DB more easily migrate to the developing roller 43.

When the voltage value is set at the second voltage value higher than the first voltage value, an electric field intensity between the circumferential surface 55 of the developing roller 43 and the magnetic brush layer becomes larger than during the development period. Thus, the toner particles T in the magnetic bristles DB strongly collide with the exposed attached matter AD. In this way, the attached matter AD becomes more easily peelable from the circumferential surface.

On the other hand, if the frequency is set at the second frequency higher than the first frequency, the toner particles T in the magnetic brush layer more frequently reciprocate between the circumferential surface 55 and the magnetic brush layer than during the development period. Thus, the toner particles T in the magnetic brush layer can more frequently collide with the exposed attached matter AD. This makes the attached matter AD more easily peelable from the circumferential surface 55. Note that FIG. 6 diagrammatically show colliding motions of the toner particles T with the attached matter AD and the magnetic bristles DB are not shown here to clearly show the motions of the toner particles T.

Finally, the controller U performs the scraping step. More specifically, since the magnetic roller 42 is rotating by the control of the drive source M by the controller U, a multitude of magnetic bristles DB on the circumferential surface 48 successively come into contact with the easily peelable attached matter AD as shown in FIG. 7. Thus, the attached matter AD is easily scraped off from the circumferential surface 55 of the developing roller 43 by the magnetic brush layer.

As described above, since the attached matter AD can be removed from the circumferential surface 55 of the developing roller 43 by the removal control by the controller U, the toner layer TL with a sufficient thickness can be formed on the circumferential surface 55 during the development period. As a result, a reduction in the toner density of the toner image is prevented and the toner image with good quality can be formed.

More specifically, the controller U first controls the second applying portion 57 as the separating portion to separate the residual toner particles on the bearing surface (first step) upon executing the removal control to remove an attached matter adhering to the bearing surface of the developing roller 43 as the toner bearing member. Thus, the attached matter on the bearing surface is exposed by being released from the covered state by the residual toner particles.

Subsequently, the controller U applies the second bias, the voltage value of which is set at the second voltage value or the frequency of which is set at the second frequency, to the toner bearing member (second step). When the voltage value is set at the second voltage value higher than the first voltage value, the electric field intensity between the bearing surface and the developer layer on the magnetic roller 42 (developer bearing member) becomes larger than during the development period. Since this can cause the toner particles in the developer layer to strongly collide with the attached matter, the attached matter becomes easily peelable from the bearing surface. When the frequency is set at the second frequency higher than the first frequency, the toner particles in the developer layer more frequently reciprocate between the bearing surface and the developer layer. Since this causes the toner particles in the developer layer to more frequently collide with the attached matter, the attached matter becomes easily peelable from the bearing surface.

When the developer layer comes into contact with the attached matter, which is exposed on the bearing surface and easily peelable from the bearing surface as described above, according to the rotation of the developer bearing member, the attached matter is easily scraped off from the bearing surface by the developer layer.

Although one of the voltage value and the frequency of the first bias is set higher than during the development period in the above removal control, the removal control may be executed after the voltage value is set at the second voltage value and the frequency is set at the second frequency. In this case, a synergetic effect of being able to cause the toner particles T having a high collision strength to more frequently collide with the attached matter AD is obtained. In this way, the attached matter AD can be more easily scraped off from the circumferential surface 55.

In this embodiment, the removal control is particularly executed after toner images are successively developed at a low coverage rate a predetermined number of times. The developer pumped up by the magnetic roller 42 has a higher chance of being restricted by the developer restricting blade 44 during a developing operation at a low coverage rate than during a developing operation at a high coverage rate and is exposed to a stress at the time of restriction by that much. Thus, the developer is more easily deteriorated during the developing operation at the low coverage rate. With the deteriorated developer, a toner image with good image quality cannot be obtained. However, by performing the removal control after the developing operation at the low coverage rate, deteriorated toner particles included in the residual toner particles RT on the circumferential surface 55 of the developing roller 43 can be discharged to the outside in the separation step. In this way, the amount of the deteriorated toner particles used for development can be reduced.

Since the separating portion for separating the residual toner particles RT from the circumferential surface 55 of the developing roller 43 and discharging them to the outside is constructed by the second applying portion 57 in this embodiment, it is not necessary to use a special member for removing the residual toner particles RT in the removal control.

Further, in this embodiment, the second applying portion 57 causes the toner particles to migrate from the developer layer to the bearing surface by applying the first bias to the developing roller 43 to produce a potential difference between the developing roller 43 and the magnetic roller 42. The toner particles include the external additive that imparts the charging property to the toner particles, and the external additive peeled off from the toner particles become an attached matter.

When the external additive that imparts the charging property to the toner particles is peeled off and adheres to the bearing surface of the developing roller 43, the electrical resistance of the bearing surface increases and electric charges are accumulated on the bearing surface. Thus, during the development period, the first bias applied to the developing roller 43 varies on the surface and the potential difference between the developing roller 43 and the magnetic roller 42 decreases. When the potential difference decreases, the toner particles do not sufficiently migrate from the developer layer to the bearing surface and it is difficult to form a toner layer with a sufficient thickness. However, since the developing device 122 according to this embodiment can remove an attached matter by the removal control by the controller U, a toner layer with a sufficient thickness can be formed on the bearing surface of the developing roller 43. In this way, a reduction in the toner density of the toner image is prevented and the toner image with good image quality can be obtained.

Next, an experiment is described in which an attached matter was removed by executing the removal control described above. In the experiment, the scraped amount of the attached matter removed by the removal control was measured. Upon conducting the experiment, an attached matter having a layer thickness of 30 μm was attached to the circumferential surface 55 of the developing roller 43. After the clearance S between the circumferential surface 55 of the developing roller 43 and the circumferential surface 48 of the magnetic roller 42 was set at 130 μm and the rotating speeds of the developing roller 43 and the magnetic roller 42 were respectively set at 400 mm/sec and 600 mm/sec, the scraped amount of the attached matter was measured while the second voltage value was changed in a range of 1.3 to 1.9 kV and the second frequency was changed in a range of 4.0 to 10.0 kHz.

Figure 8:
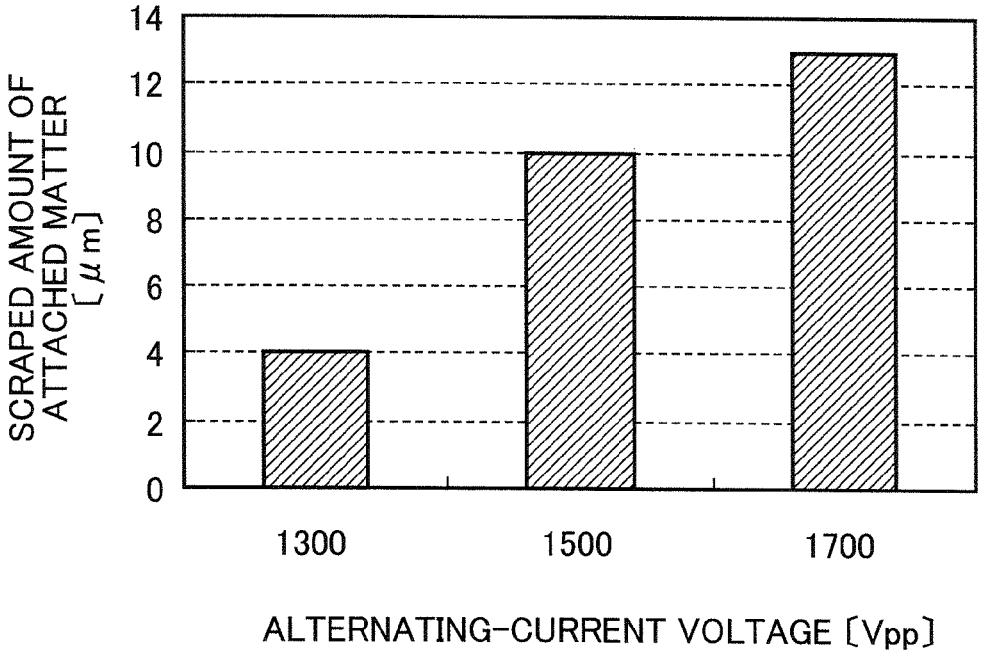
FIG. 8 is a graph showing a measurement result on the scraped amount of an attached matter when only a second voltage was changed in the removal control.
Figure 9:
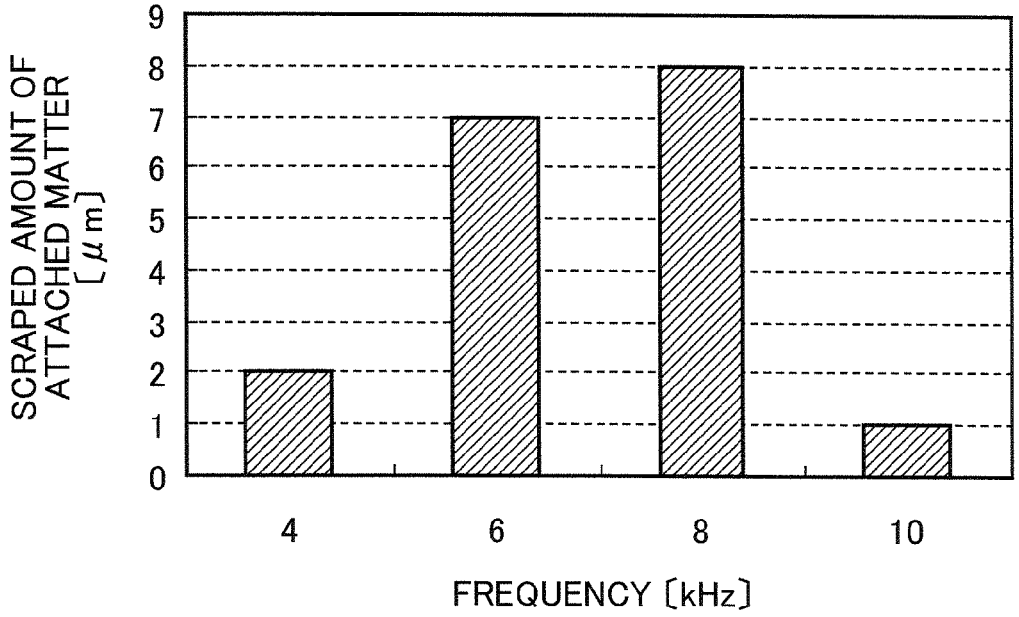
FIG. 9 is a graph showing a measurement result on the scraped amount of an attached matter when only a second frequency was changed in the removal control.
Figure 10:
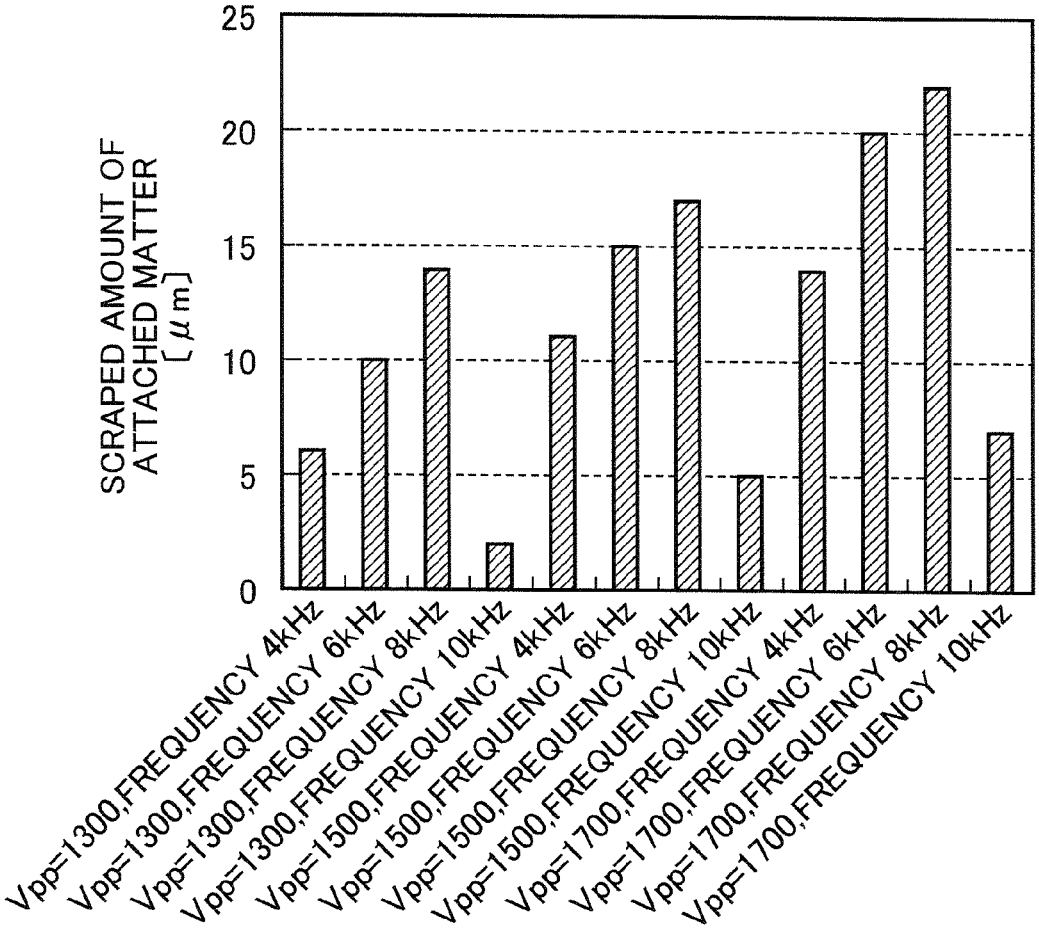
FIG. 10 is a graph showing a measurement result on the scraped amount of an attached matter when both the second voltage and the second frequency were changed in the removal control.
Figure 11:
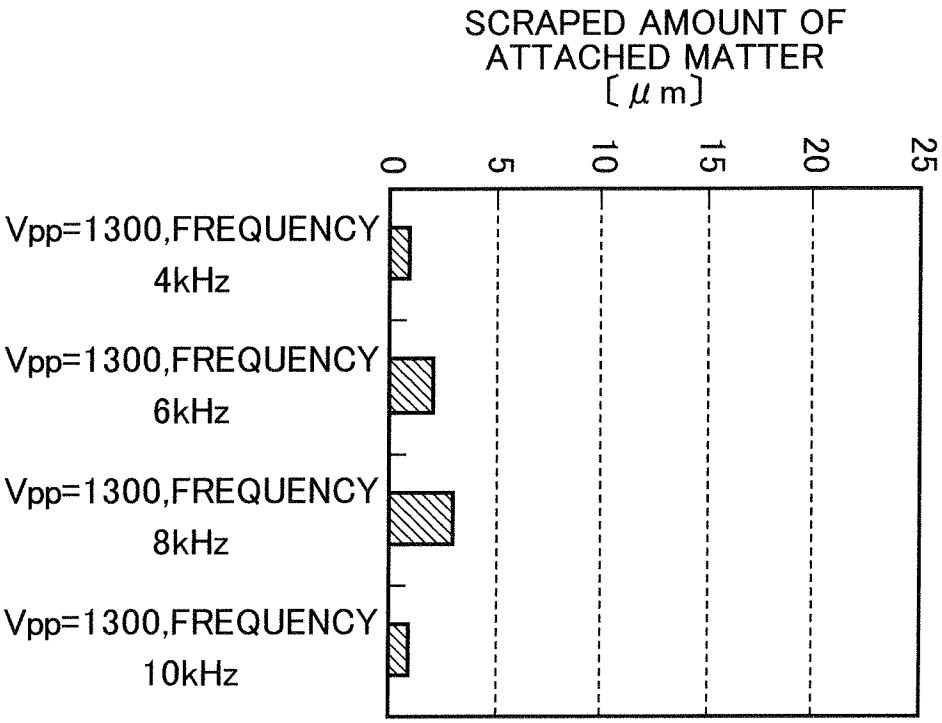
FIG. 11 is a graph showing a measurement result on the scraped amount of an attached matter when only the second frequency was changed without forcibly discharging residual toner particles.

FIG. 8 is a graph showing a measurement result on the scraped amount of an attached matter when only the second voltage value was changed in the removal control by the controller U. FIG. 9 is a graph showing a measurement result on the scraped amount of an attached matter when only the second frequency was changed in the removal control by the controller U. FIG. 10 is a graph showing a measurement result on the scraped amount of an attached matter when both the second voltage value and the second frequency were changed in the removal control by the controller U. On the other hand, FIG. 11 is a graph showing a measurement result on the scraped amount of an attached matter when only the second frequency was changed without forcibly discharging residual toner particles.

As shown in FIG. 8, it was confirmed that a larger amount of the attached matter was scraped off when the second voltage value was set at 1.5 kV or 1.7 kV higher than the first voltage value (1.4 kV) at the time of the developing operation. Further, the scraped amount was larger when the second voltage value was set at 1.7 kV than when it was set at 1.5 kV. On the other hand, it was confirmed that a smaller amount of the attached matter was scraped off when the second voltage value was set at 1.3 kV lower than the first voltage value. Further, a discharge phenomenon was confirmed when the second voltage value was set at 1.9 kV.

Further, as shown in FIG. 9, it was confirmed that a larger amount of the attached matter was scraped off when the second frequency was set at 6.0 kHz or 8.0 kHz higher than the first frequency (4.2 kHz) at the time of the developing operation. Further, the scraped amount was larger when the second frequency was set at 8.0 kHz than when it was set at 6.0 kHz. On the other hand, it was confirmed that the scraped amount was smaller when the second frequency was set at 4.0 kHz lower than the first frequency. It was also confirmed that the scraped amount was even smaller when the second frequency was set at 10.0 kHz. The reason why the scraped amount was small despite the fact that the second frequency was set at 10.0 kHz considerably higher than the first frequency is thought to be that the toner particles did not actually come into contact with the attached matter although more frequently reciprocating between the circumferential surface 55 of the developing roller 43 and the magnetic brush layer when the frequency reached the vicinity of 10.0 kHz.

Further, as shown in FIG. 10, it was confirmed that an extremely large amount of the attached matter was scraped off when the second voltage value was set higher than the first voltage value and the second frequency was set higher than the first frequency, i.e. when the second voltage value was set at 1.5 kV and the second frequency was set at 6.0 to 8.0 kHz or when the second voltage value was set at 1.7 kV and the second frequency was set at 6.0 to 8.0 kHz. It was also confirmed that a sufficient scraped amount was obtained when the second frequency was set at 6.0 to 8.0 kHz higher than the first frequency even if the second voltage value was set at 1.3 kV lower than the first voltage value. It was further confirmed that a sufficient scraped amount was obtained when the second voltage value was set at 1.5 to 1.7 kV higher than the first voltage value even if the second frequency was set at 4.0 kHz lower than the first frequency.

On the other hand, as shown in FIG. 11, it was confirmed that a sufficient scraped amount could not be obtained unless the separation step of separating the residual toner particles from the circumferential surface 55 of the developing roller 43 and forcibly discharging them to the outside was performed even if the second frequency was set at 6.0 to 8.0 kHz higher than the first frequency. From the result of FIG. 11, it was confirmed to be necessary to expose the attached matter by performing the separation step in order to obtain a sufficient scraped amount.

This application is based on Japanese Patent application No. 2010-165977 filed in Japan Patent Office on Jul. 23, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device for performing a developing operation of supplying toner particles to a predetermined image bearing member, comprising:

a storage portion for storing a developer containing toner particles and carrier particles;

a developer bearing member for receiving the developer from the storage portion and bearing a developer layer while rotating in a predetermined direction;

a toner bearing member having a bearing surface for receiving the toner particles from the developer and bearing a toner layer while rotating in contact with the developer layer and adapted to supply the toner particles in the toner layer to the image bearing member during a development period in which the developing operation is performed;

a drive source for rotating the developer bearing member and the toner bearing member;

a restricting member located upstream of the toner bearing member in the rotating direction of the developer bearing member and adapted to restrict the thickness of the developer layer on the developer bearing member;

an applying portion for applying a first bias, the voltage value of which is a first voltage value and the frequency of which is a first frequency, to the toner bearing member during the development period;

a separating portion for separating residual toner particles remaining on the bearing surface from the bearing surface during a non-development period in which the developing operation is not performed and discharging the separated residual toner particles to the outside; and a controller for executing a removal control to remove an attached matter adhering to the bearing surface of the toner bearing member during the non-development period;

wherein, upon executing the removal control, the controller first controls the separating portion to separate the residual toner particles from the bearing surface and then controls the applying portion to cause a second bias, at least the voltage value of which is set at a second voltage value higher than the first voltage value of the first bias or the frequency of which is set at a second frequency higher than the first frequency of the first bias, to be applied to the toner bearing member while controlling the drive source to rotate the developer bearing member and the toner bearing member, thereby bringing the developer layer into contact with the bearing surface; and the controller executes the removal control after a toner image having a low coverage rate is developed.

2. A developing device according to claim 1, wherein:

the controller controls the applying portion such that the second bias, the voltage value of which is set at the second voltage value and the frequency of which is set at the second frequency, to be applied to the toner bearing member.

3. A developing device according to claim 1, wherein:

the separating portion causes the residual toner particles to migrate from the bearing surface to the predetermined image bearing member by producing a potential difference between the toner bearing member and the predetermined image bearing member.

4. A developing device for performing a developing operation of supplying toner particles to a predetermined image bearing member, comprising:

a storage portion for storing a developer containing toner particles and carrier particles;

a developer bearing member for receiving the developer from the storage portion and bearing a developer layer while rotating in a predetermined direction;

a toner bearing member having a bearing surface for receiving the toner particles from the developer and bearing a toner layer while rotating in contact with the developer layer and adapted to supply the toner particles in the toner layer to the image bearing member during a development period in which the developing operation is performed;

a drive source for rotating the developer bearing member and the toner bearing member;

an applying portion for applying a first bias, the voltage value of which is a first voltage value and the frequency of which is a first frequency, to the toner bearing member during the development period, the applying portion causes the toner particles to migrate from the developer layer to the bearing surface by producing a potential difference between the toner bearing member and the developer bearing member by applying the first bias to the toner bearing member;

a separating portion for separating residual toner particles remaining on the bearing surface from the bearing surface during a non-development period in which the developing operation is not performed; and a controller for executing a removal control to remove an attached matter adhering to the bearing surface of the toner bearing member during the non-development period;

wherein, upon executing the removal control, the controller first controls the separating portion to separate the residual toner particles from the bearing surface and then controls the applying portion to cause a second bias, at least the voltage value of which is set at a second voltage value higher than the first voltage value of the first bias or the frequency of which is set at a second frequency higher than the first frequency of the first bias, to be applied to the toner bearing member while controlling the drive source to rotate the developer bearing member and the toner bearing member, thereby bringing the developer layer into contact with the bearing surface;

the toner particles include an external additive which imparts a charging property to the toner particles; and the attached matter is the external additive peeled off from the toner particles.

5. An image forming apparatus, comprising:

an image bearing member on which a toner image is to be formed;

a developing device for performing a developing operation of supplying toner particles to the image bearing member;

a transfer member for transferring the toner image onto a sheet; and a fixing unit for fixing the toner image on the sheet to the sheet, wherein the developing device includes:

a storage portion for storing a developer containing toner particles and carrier particles;

a developer bearing member for receiving the developer from the storage portion and bearing a developer layer while rotating in a predetermined direction;

a toner bearing member having a bearing surface for receiving the toner particles from the developer and bearing a toner layer while rotating in contact with the developer layer and adapted to supply the toner particles in the toner layer to the image bearing member during a development period in which the developing operation is performed;

a drive source for rotating the developer bearing member and the toner bearing member;

a restricting member located upstream of the toner bearing member in the rotating direction of the developer bearing member and adapted to restrict the thickness of the developer layer on the developer bearing member;

an applying portion for applying a first bias, the voltage value of which is a first voltage value and the frequency of which is a first frequency, to the toner bearing member during the development period;

a separating portion for separating residual toner particles remaining on the bearing surface from the bearing surface during a non-development period in which the developing operation is not performed and discharging the separated residual toner particles to the outside; and a controller for executing a removal control to remove an attached matter adhering to the bearing surface of the toner bearing member during the non-development period;

wherein, upon executing the removal control, the controller first controls the separating portion to separate the residual toner particles from the bearing surface and then controls the applying portion to cause a second bias, at least the voltage value of which is set at a second voltage value higher than the first voltage value of the first bias or the frequency of which is set at a second frequency higher than the first frequency of the first bias, to be applied to the toner bearing member while controlling the drive source to rotate the developer bearing member and the toner bearing member, thereby bringing the developer layer into contact with the bearing surface; and the controller executes the removal control after a toner image having a low coverage rate is developed.

6. An image forming apparatus according to claim 5, wherein:

the controller controls the applying portion such that the second bias, the voltage value of which is set at the second voltage value and the frequency of which is set at the second frequency, to be applied to the toner bearing member.

7. An image forming apparatus according to claim 3, wherein:

the separating portion causes the residual toner particles to migrate from the bearing surface to the predetermined image bearing member by producing a potential difference between the toner bearing member and the predetermined image bearing member.

8. An image forming apparatus, comprising:

an image bearing member on which a toner image is to be formed;

a developing device for performing a developing operation of supplying toner particles to the image bearing member;

a transfer member for transferring the toner image onto a sheet; and a fixing unit for fixing the toner image on the sheet to the sheet, wherein the developing device includes:

a storage portion for storing a developer containing toner particles and carrier particles;

a developer bearing member for receiving the developer from the storage portion and bearing a developer layer while rotating in a predetermined direction;

a toner bearing member having a bearing surface for receiving the toner particles from the developer and bearing a toner layer while rotating in contact with the developer layer and adapted to supply the toner particles in the toner layer to the image bearing member during a development period in which the developing operation is performed;

a drive source for rotating the developer bearing member and the toner bearing member;

an applying portion for applying a first bias, the voltage value of which is a first voltage value and the frequency of which is a first frequency, to the toner bearing member during the development period, the applying portion causes the toner particles to migrate from the developer layer to the bearing surface by producing a potential difference between the toner bearing member and the developer bearing member by applying the first bias to the toner bearing member;

a separating portion for separating residual toner particles remaining on the bearing surface from the bearing surface during a non-development period in which the developing operation is not performed; and a controller for executing a removal control to remove an attached matter adhering to the bearing surface of the toner bearing member during the non-development period;

wherein, upon executing the removal control, the controller first controls the separating portion to separate the residual toner particles from the bearing surface and then controls the applying portion to cause a second bias, at least the voltage value of which is set at a second voltage value higher than the first voltage value of the first bias or the frequency of which is set at a second frequency higher than the first frequency of the first bias, to be applied to the toner bearing member while controlling the drive source to rotate the developer bearing member and the toner bearing member, thereby bringing the developer layer into contact with the bearing surface;

the toner particles include an external additive which imparts a charging property to the toner particles; and the attached matter is the external additive peeled off from the toner particles.

* * * * *